US005887739A

United States Patent [19]

Prevot et al.

[11] Patent Number: 5,887,739

[45] Date of Patent: Mar. 30, 1999

[54] OVALIZATION AND CRUSH RESISTANT CONTAINER

[75] Inventors: Roger M. Prevot, Felton, Pa.; Tracy Marie Momany, Sylvania, Ohio

[73] Assignee: Graham Packaging Company, L.P., York, Pa.

[21] Appl. No.: 942,556

[22] Filed: Oct. 3, 1997

[51] Int. Cl.[6] ..... B65D 90/02

[52] U.S. Cl. ..... 215/382; 215/42

[58] Field of Search ..... 215/382, 379, 215/381, 383, 384; 220/608, 624, 619, 666, 672, 673, 675, 674, 659; 29/538, 534

[56] References Cited

U.S. PATENT DOCUMENTS

| | | | |
|---|---|---|---|
| D. 61,658 | 11/1922 | Graham | D9/538 |
| D. 86,118 | 2/1932 | Fuerst . | |
| D. 86,408 | 3/1932 | Piazzoli . | |
| D. 87,424 | 7/1932 | Arena | D9/538 |
| D. 153,177 | 3/1949 | Schmitz | D9/538 |
| D. 177,263 | 3/1956 | Kilmon, Jr. | D9/538 |
| D. 189,540 | 1/1961 | Miller | 215/382 X |
| D. 193,311 | 7/1962 | Buckley . | |
| D. 234,741 | 4/1975 | Emmons | 215/382 X |
| D. 249,121 | 8/1978 | Strand . | |
| D. 339,291 | 9/1993 | Leigner . | |
| D. 364,093 | 11/1995 | Weaver, Jr. . | |
| D. 366,417 | 1/1996 | Semersky . | |
| D. 370,850 | 6/1996 | Beaver . | |
| D. 381,274 | 7/1997 | Luh et al. . | |
| D. 382,807 | 8/1997 | Silvers et al. . | |
| D. 387,285 | 12/1997 | Balz et al. | D9/538 |
| D. 387,670 | 12/1997 | Larkin | D9/538 |
| 5,054,632 | 10/1991 | Alberghini et al. | 215/381 |
| 5,064,081 | 11/1991 | Hayashi et al. | 215/381 X |
| 5,067,622 | 11/1991 | Garver et al. | 215/382 X |
| 5,092,474 | 3/1992 | Leigner . | |
| 5,224,614 | 7/1993 | Bono et al. | 215/381 |
| 5,261,544 | 11/1993 | Weaver, Jr. . | |
| 5,690,244 | 11/1997 | Darr . | |

*Primary Examiner*—Gary E. Elkins
*Assistant Examiner*—Tri M. Mai
*Attorney, Agent, or Firm*—Howson and Howson

[57] ABSTRACT

A container dome with arch-like structures in elevation and polygon-shaped structures in plan. The arch-like structures are provided by pairs of chordal stiffening facets disposed in an endwise adjacent array extending transversely about the periphery of the dome to enhance top loading capability. Each pair of facets has an inwardly-convex chordal stiffening rib which defines a regular transverse polygon having an uneven number of sides to prevent dome ovalization. Preferably, multiple vertically-stacked tiers of facet pairs arrays are utilized with each array being radially offset from adjacent tiers.

29 Claims, 4 Drawing Sheets

OVALIZATION AND CRUSH RESISTANT CONTAINER

FIELD OF THE INVENTION

The present invention relates to a blow-molded plastic container having a dome specifically designed to resist ovalization and to provide improved top loading capability, and more particularly, the present invention relates to a dome configuration which is especially useful on hot, or cold, fillable wide mouth jars, or narrow neck bottles.

BACKGROUND OF THE INVENTION

Blow-molded plastic containers are becoming more commonplace in packaging edible consumer goods such as peanut butter, pickles, applesauce and like food products. Traditionally, such products have been supplied in wide mouth glass jars which provide a relatively heavy, inflexible, sturdy container. Blow-molded plastic containers have the advantages that their light weight reduces transportation costs.

Plastic containers are continually being re-designed in an effort to reduce the amount of plastic required to make the container. While there can be a savings with respect to material cost, the reduction of plastic can decrease container rigidity and structural integrity. Thus, a problem with plastic containers is that many forces act on, and alter, the as-designed shape of the container, particularly its dome configuration, from the time it is blow-molded to the time it is placed on a shelf in a store.

In the packaging of food and beverage products, blow-molded plastic containers can be used in the so-called "hot-fill" process, i.e. filling the containers with a food or beverage product at an elevated temperature, sealing the containers, and then allowing the food or beverage to cool. Internal vacuum forces act on the container as a result of hot-fill processing. Hot-fillable plastic containers must provide sufficient flexure to compensate for the internal changes in pressure and temperature, while maintaining structural integrity and aesthetic appearance. The flexure is most commonly addressed with vacuum flex panels positioned under a label below the dome.

External forces are applied to sealed containers as they are packed, shipped and stored. Filled containers are packed in bulk in cardboard boxes, or plastic wrap, or both. A bottom row of packed, filled containers may support several upper tiers of filled containers, and potentially, several upper boxes of filled containers. Therefore, it is important that the container have a top loading capability which is sufficient to prevent distortion from the intended container shape.

Dome region ovalization is a common distortion associated with blow-molded plastic containers, especially if hot-filled. Some dome configurations are designed to have a horizontal cross-section which is substantially circular in shape. The forces resulting from hot-filling can change the intended horizontal cross-sectional shape, for example, from circular to oval, creating carton packing and label adhesion problems, among others.

Although various containers having a specific dome configuration may function satisfactorily for their intended purposes, there is a need for a blow-molded plastic container, particularly a blow-molded plastic wide mouth jar or narrow neck bottle, having an improved reinforced dome which resists ovalization distortion due to hot-filling, and resists compressive distortions due to top loading. A container having the dome should be capable of being made from a minimum of plastic to afford efficient manufacture.

OBJECTS OF THE INVENTION

With the foregoing in mind, a primary object of the present invention is to provide a novel blow-molded plastic container having a dome which resists distortion.

Another object of the present invention is to provide a container dome configuration capable of maintaining its structural integrity and aesthetic appearance despite the distortion-inducing internal container pressures caused by hot-filling.

A further object is to provide a container having an improved dome with sufficient top loading capabilities to withstand the rigors of shipping and storage.

A still further object is to provide a hot-fillable, plastic, wide mouth jar with a dome configuration which is inexpensive to manufacture, structurally sound, and aesthetically appealing.

SUMMARY OF THE INVENTION

More specifically, the present invention provides a blow-molded container which is ovalization and crush resistant. The container has a dome which connects a sidewall portion to a finish. The dome has a plurality of chordal stiffening facets disposed in an endwise adjacent array extending transversely about its periphery between the finish and sidewall portion. Each facet has an inwardly-convex chordal rib forming an inflection between an upright and a transverse facet wall portion of the dome, and each facet wall portion has an outwardly convex peripheral rib with an apogee located intermediate opposite ends of the chordal rib. Portions of the peripheral rib extend in opposite directions from the apogee toward opposite ends of the chordal rib. Preferably an uneven number of chordal ribs are used to define a regular transverse polygon.

BRIEF DESCRIPTION OF THE DRAWINGS

The foregoing and other objects, features and advantages of the present invention should become apparent from the following description when taken in conjunction with the accompanying drawings, in which.

DETAILED DESCRIPTION OF THE PREFERRED EMBODIMENT

Figure 1:
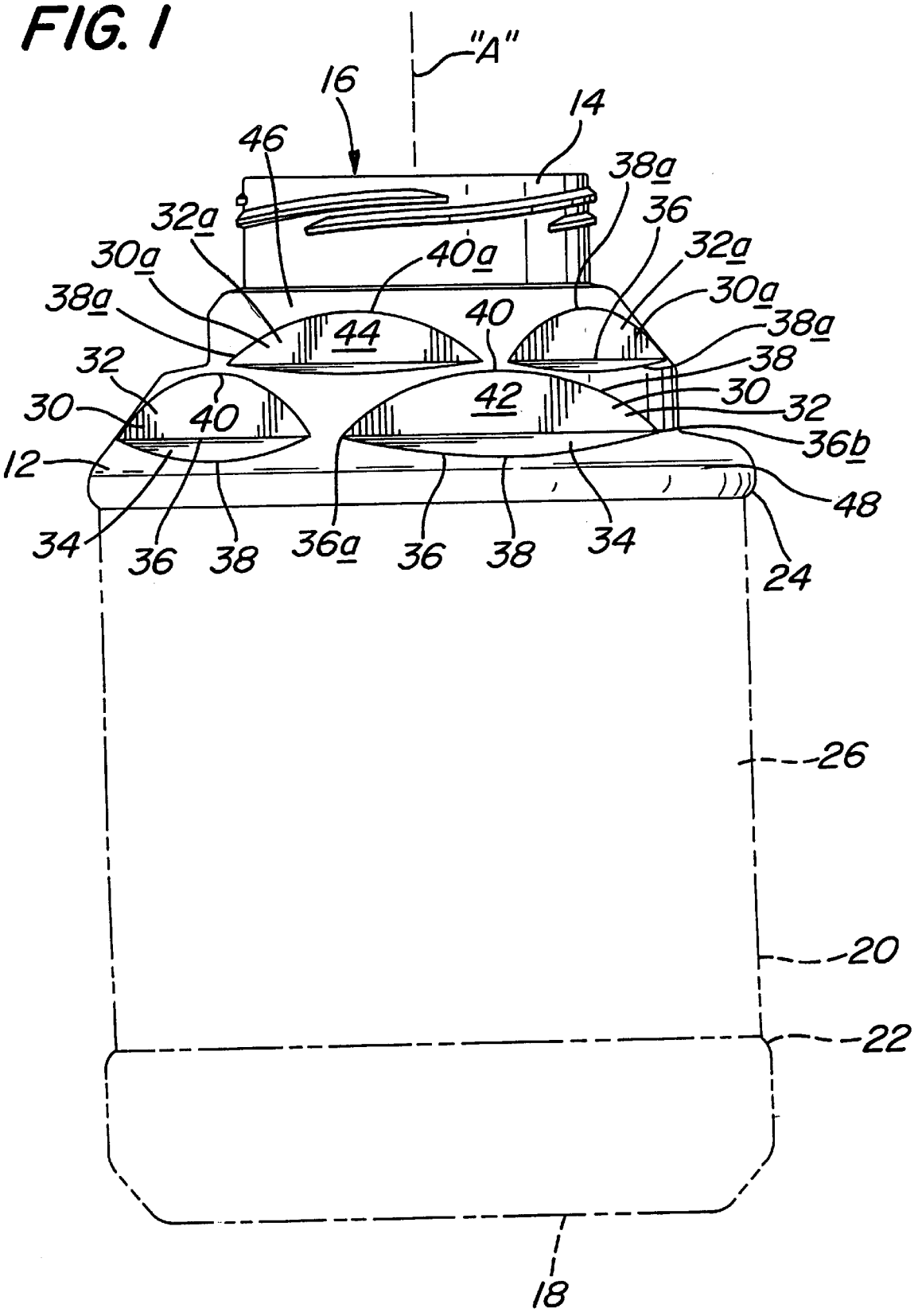
FIG. 1 is an elevational view of a container having a dome embodying the present invention.
Figure 2:
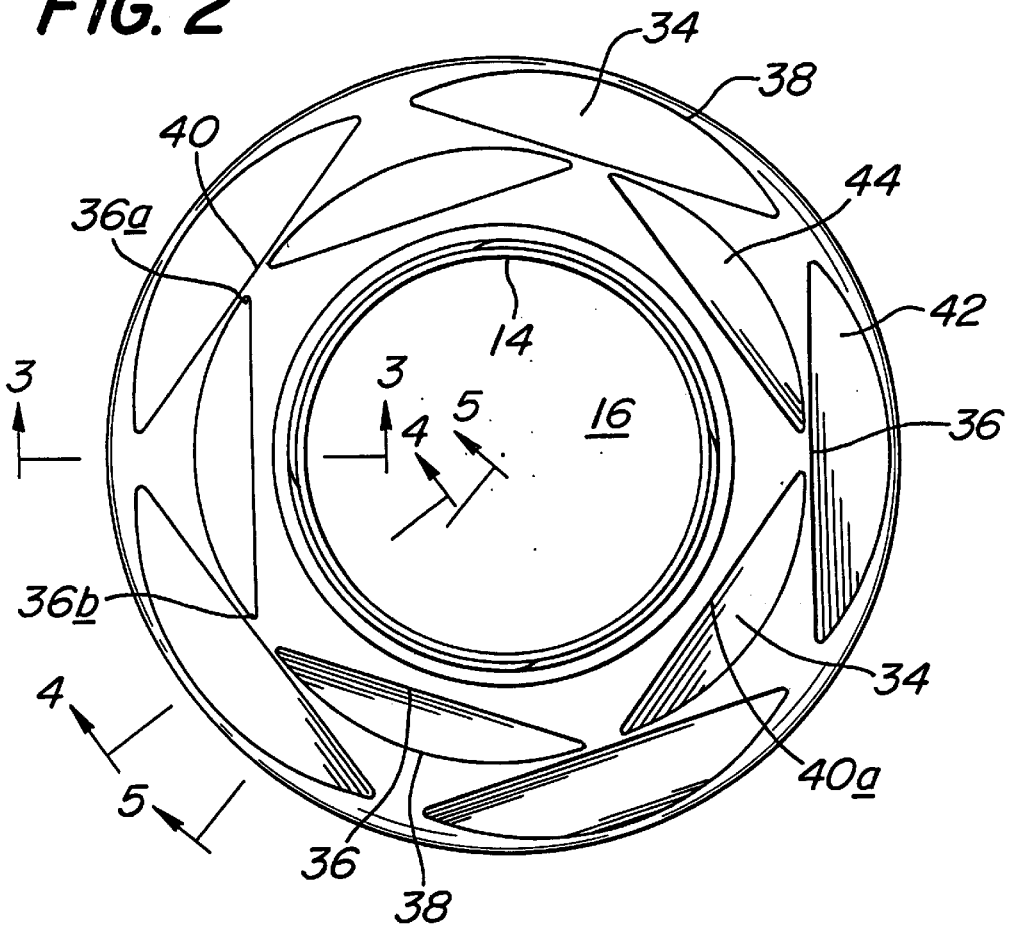
FIG. 2 is a top plan view of the dome.
Figure 3:
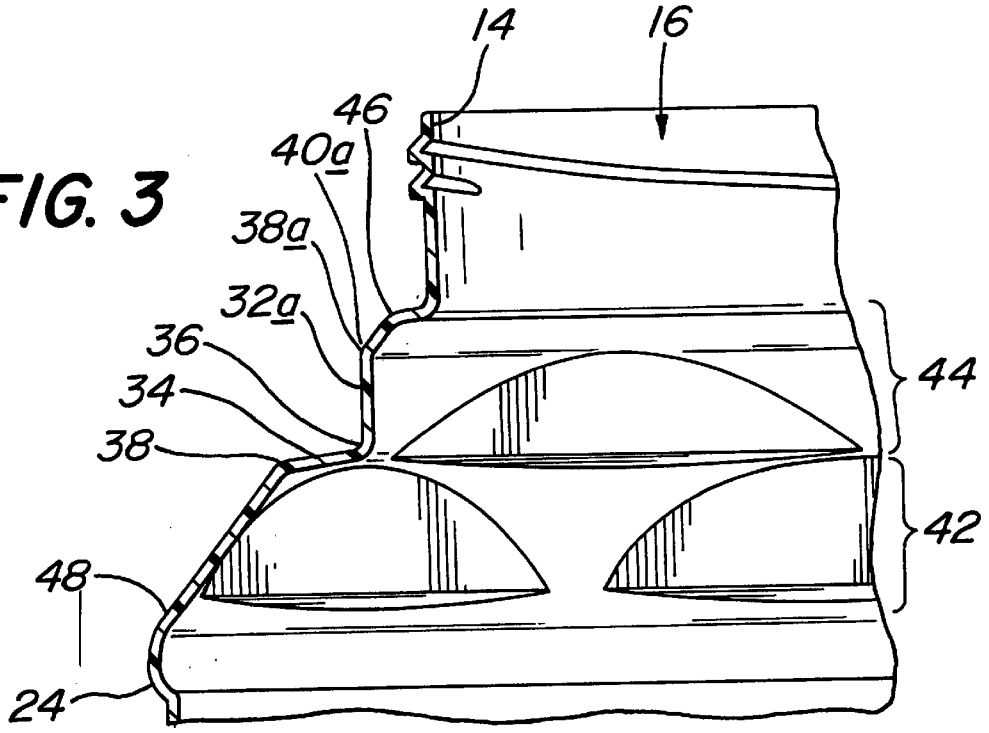
FIG. 3 is a cross-sectional view of the dome taken along line 3—3 of FIG. 2.
Figure 4:
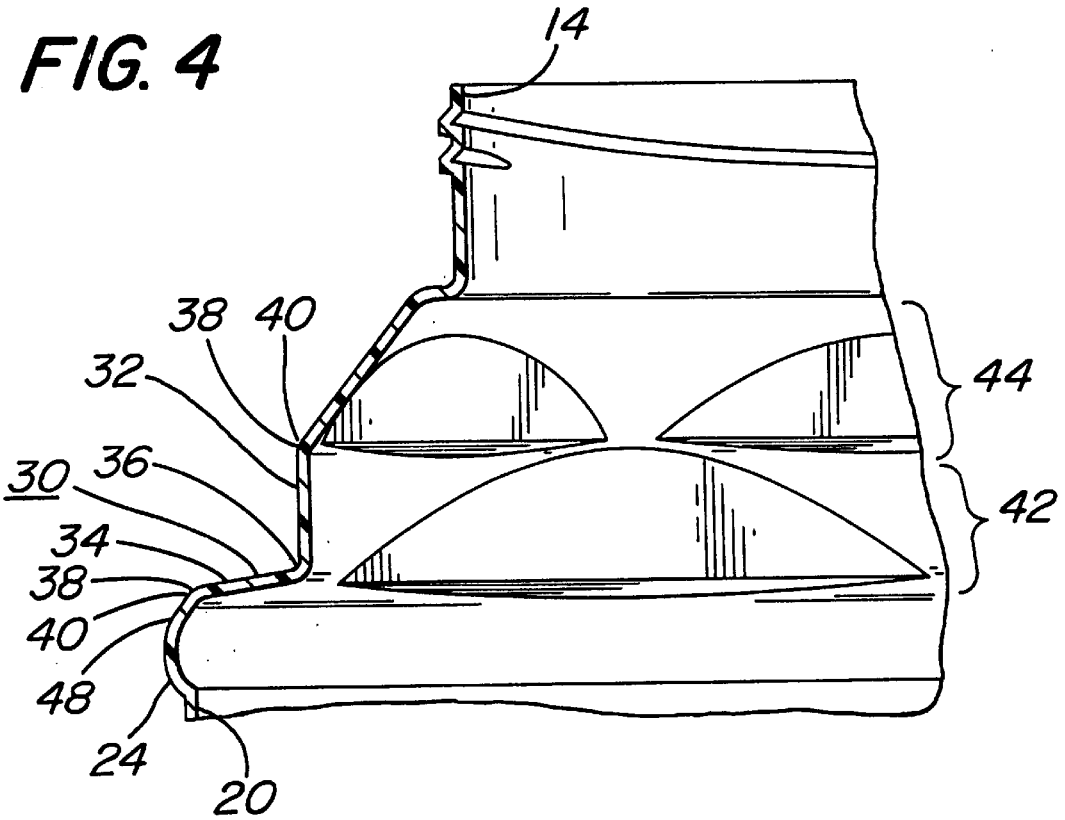
FIG. 4 is a cross-sectional view of the dome taken along line 4—4 of FIG. 2.
Figure 5:
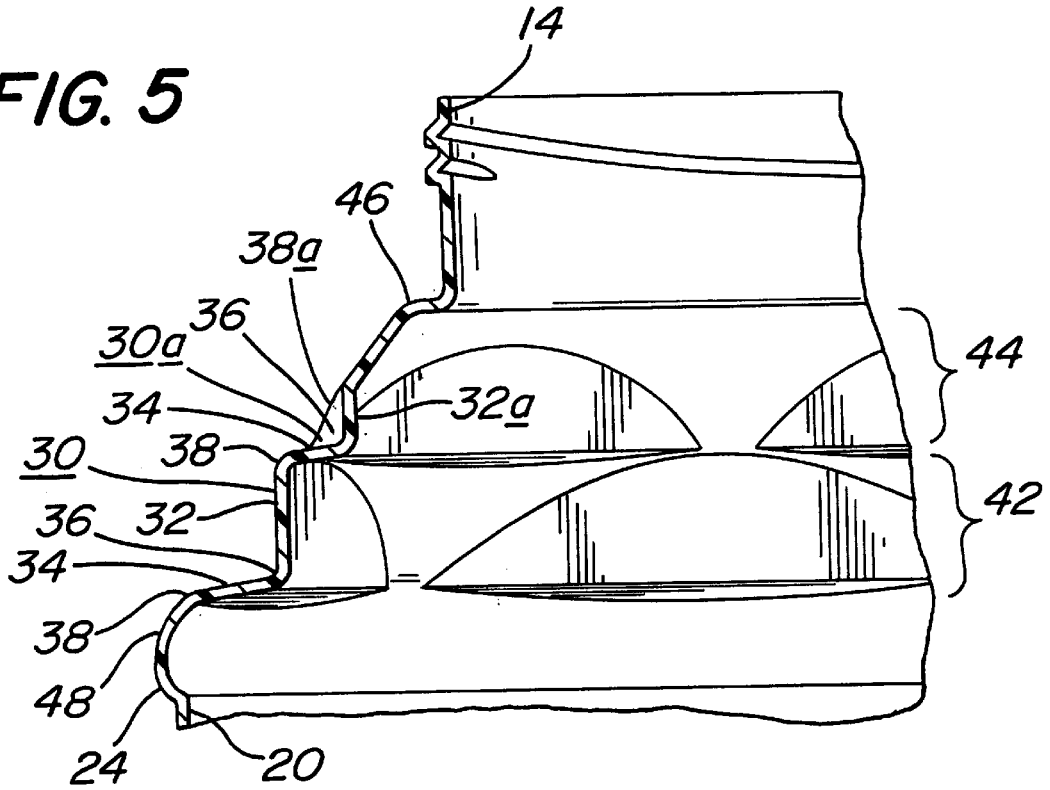
FIG. 5 is a cross-sectional view of the dome taken along line 5—5 of FIG. 2.
Figure 6:
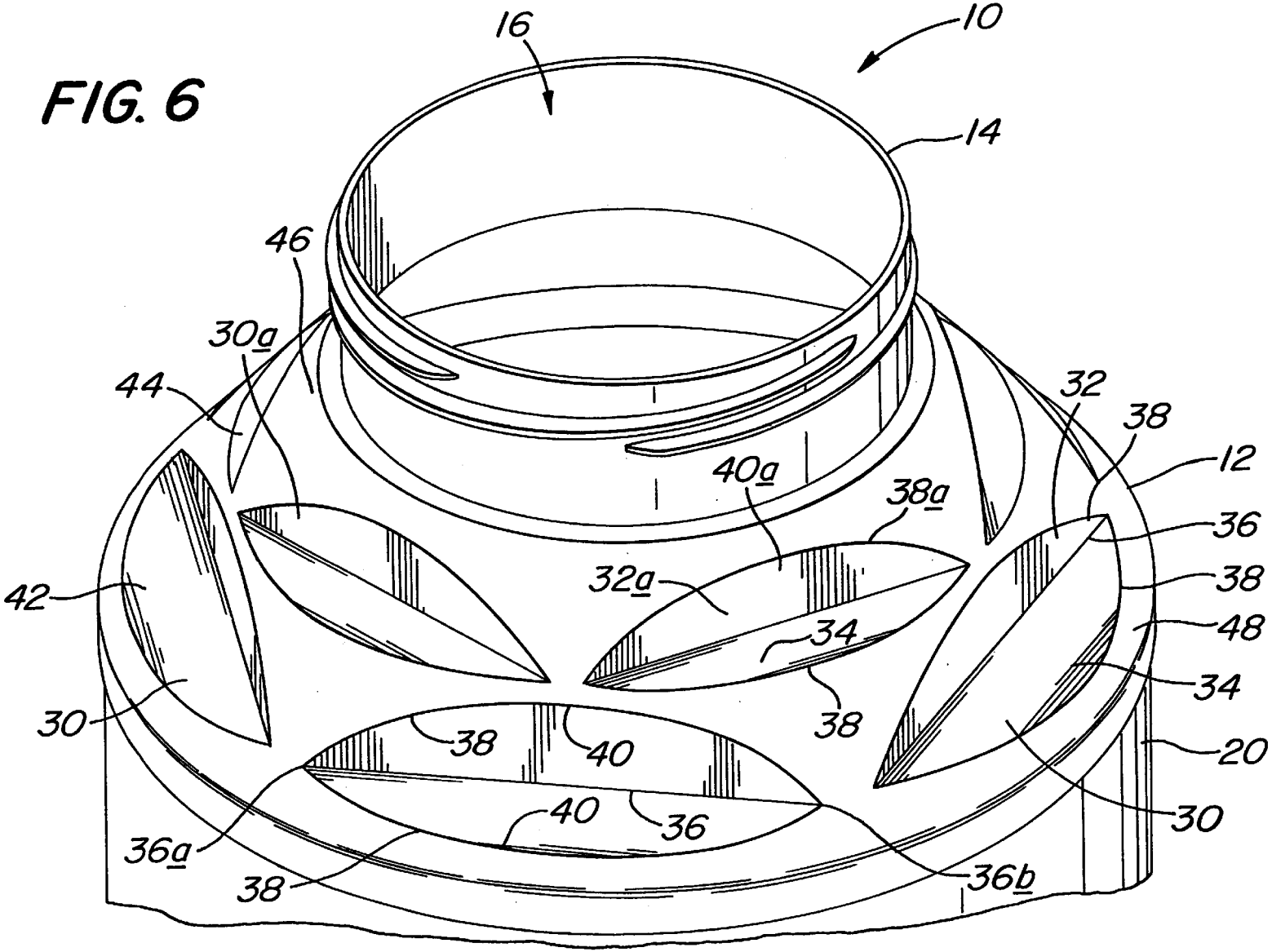
FIG. 6 is a perspective view of the dome.

FIG. 1 illustrates a blow-molded container 10 having an ovalization and crush resistent dome 12 according to the present invention. The preferred container 10, as illustrated, has a wide mouth making it particularly useful for packaging a food product such as, for example, applesauce, peanut butter, or like semi-liquid foods. However, the dome 12 can be used on any type, size or shape of blow-molded container and can be used to package many different liquid or semi-liquid beverage, food and consumer products. The dome 12 is designed to provide an aesthetically appealing package as well as to resist distortion caused by hot-filling and top-loading.

The container 10 has many features which are common to known blow-molded containers. The dome 12 has a threaded finish 14 which provides an opening 16 through which the container 10 is filled and subsequently sealed. A base 18 is located remote from the finish 14 and extends to an annular sidewall portion 20. The annular sidewall portion 20 includes a lower label bumper 22 adjacent the base 18 and an upper label bumper 24 located adjacent the dome 12. The upper and lower label bumpers, 22 and 24, define the extent of a label mounting area 26 which, if the container 10 is intended for hot-filling, has a series of spaced-apart vacuum flex panels (not shown) which accommodate volumetric changes in the hot-filled container after it has been sealed, capped and cooled to ambient temperatures. The disclosure of vacuum flex panels as illustrated in the drawings of U.S. Design Pat. No. D.366,417 is incorporated herein by reference.

The unique aspect of the present invention is the stiffening structure in the dome 12 which provides the container 10 with greater top-loading capability and greater control of dome distortion, such as ovalization. As will be discussed in greater detail, in elevation, the dome is provided with arch-like facet structures to enhance top-loading capabilities, and in plan, the dome is provided with chordal stiffening ribs arranged to form polygon-shaped structures to prevent ovalization of the dome.

The above described stiffening of the dome 12 is provided by a plurality of pairs of chordal stiffening facets 30 disposed in an endwise adjacent array extending transversely about the periphery of the dome 12 between the finish 14 and the annular sidewall portion 20. In the preferred embodiment, multiple vertically-stacked tiers of facet arrays are utilized as will be discussed.

Each pair of facets 30 includes an upright facet wall portion 32 and a transverse facet wall portion 34 connected by an inwardly-convex chordal stiffening rib 36 which forms an inflection between the upright and transverse facet wall portions, 32 and 34. In the illustrated embodiment, the upright facet wall portion 32 extends substantially parallel to the central axis "A" of the container 10, and the transverse wall portion 34 extends substantially perpendicular to the central axis "A" of the container 10. Thus, the inflection formed between the upright and transverse facet wall portions, 32 and 34, is at approximately a 90° angle, and the chordal stiffening rib 36 is substantially straight and continuous between its opposite ends. As shown in FIG. 1 all of the chordal stiffening ribs 36 lie in a common plane transverse to the container axis "A". Alternatively, an angle of greater than 90° could be formed, and the transverse wall portion 34 could extend other than perpendicular to the central axis "A".

Each of the upright and transverse wall portions, 32 and 34, extends from the inwardly-convex chordal stiffening rib 36 to a outwardly-convex peripheral rib 38. Each of the outwardly-convex peripheral ribs 38 extends from the ends, 36*a* and 36*b*, of one of the inwardly-convex chordal ribs 36 to an apogee 40 intermediate of the ends, 36*a* and 36*b*. As illustrated in the drawings, the outwardly-convex peripheral ribs 38 are arcuate; however, other shapes may be utilized.

The pairs of chordal stiffening facets 30, as described, function to reinforce the dome 12 of the container 10 against distortion. While the manner by which the chordal stiffening facets 30 function cannot be readily explained, it is believed that each outwardly-convex peripheral rib 38 of each upright facet wall portion 32 forms a truss-like structure which, much like an arch, can support a load applied downward along the upper periphery of the arch. The arch-like structures are believed to transfer loads acting downwardly in opposite directions from the apogee 40, toward the ends, 36*a* and 36*b*, of the inwardly-convex chordal stiffening rib 36, thereby placing it in tension, and also transferring downward loading between the ends of adjacent chordal stiffening ribs 36. Thus, the structure performs much like an "A" frame truss subject to a top load at its apogee. These structures combine to resist movement in both the vertical and planar directions.

Distortion is also resisted by the arrangement of the inwardly-convex chordal stiffening ribs 36 around the periphery of the dome 12 defining a regular polygon structure transverse to the longitudinal axis of the container. To maximize ovalization resistance, the regular polygon structure is preferably formed with an odd number of chordal stiffening ribs 36 and facets 30. As illustrated, five inwardly-convex chordal stiffening ribs 36 are utilized to form a pentagon structure; however, a polygon with three, seven or nine sides is also within a preferred range. If all the advantages of ovalization resistance are not required, an even number of chordal stiffening ribs 36 and facets 30 could be utilized such as, for example, four, six or eight. Functionally, the use of an odd number of chordal stiffening ribs 36 and facets 30 is believed to strongly resist ovalization due to the fact that the apogees resist movement in a planar direction, and since they are not opposed to each other, the proclivity to ovalize is neutralized.

The preferred embodiment of the reinforced dome 12 utilizes two vertically-stacked tiers, 42 and 44, of facet pairs, 30 and 30*a*, in endwise adjacent arrays. As illustrated, the second plurality of pairs of chordal stiffening facets 30*a* are superimposed above the above described facet pairs 30 and are of like construction to the above described facet pairs 30, but smaller in overall size. To enhance the strength of the dome 12, preferably the second plurality of facet pairs 30*a* are arranged such that their apogees 40*a* are radially offset from the apogees 40 of the lower tier 42 of facet pairs 30. As illustrated, each of the adjacent ends of the inwardly-convex chordal stiffening ribs 36 is disposed adjacent the apogee 40 of each sub-adjacent upright facet wall portion 32. If desired, three or more vertically-stacked tiers of facet arrays could be utilized. The number of facets per array could vary from tier to tier, or, as illustrated, each array could have an equal number of facets.

Each upper tier 44 extends to a lesser radial extent than the adjacent lower tier 42 so that the dome 12 slopes upwardly and inwardly from the annular sidewall portion 20 to the finish 14. The dome 12 has an upper narrow transitional annular wall portion 46 which extends between the outwardly-convex peripheral ribs 38 of the uppermost tier 44 of upright facet wall portions 32*a* to the finish 14, and a lower narrow transitional wall portion 48 which extends between the outwardly-convex peripheral ribs 38 of the lowermost tier 42 of transverse facet wall portions 34 to the annular sidewall portion 20 of the container 10.

The dome 12 is particularly useful on plastic wide-mouth jar-type containers which are prone to experience dome ovalization. For purposes of definition, a container is considered to have a wide-mouth if the annular finish 14 has a diameter at least 45 mm. By way of example, and not by way of limitation, the illustrated embodiment has a finish diameter of about 55 mm and a sidewall body diameter of 110 mm with the remaining container portions drawn to scale.

If the container is to be used in a hot-fill process for containing a food or beverage product, the container is preferably made of PET. However, other plastics may be utilized, such as HDPE, PP, PVC, LDPE or multi-layer structures or composites of the previous materials with other plastic materials. The container 10 is preferably blow-molded from injection-molded preforms (not shown). The injection molded finish of the preform can be used as the finish 14 of the container 10. Alternatively, the finish 14 of the container 10 can be blow-molded and the remaining portion of the preform above the blow molded finish can be cut away as flash. Blow-molding the finish 14 is particularly useful when manufacturing wide mouth containers sealed with a layer of foil over which a cap is installed.

The described container having a reinforced dome affords enhanced top loading capability and resists dome ovalization. The container can be efficiently and inexpensively blow-molded from any of several commercially-available plastics and provides an aesthetic appearance despite the rigors of hot-fill processing and top loading during shipping.

While a preferred container has been described in detail, various modifications, alterations, and changes may be made without departing from the spirit and scope of the present invention as defined in the appended claims.

We claim:

1. An ovalization and crush resistant container having a dome connecting an annular sidewall portion to a finish, said dome having a plurality of pairs of chordal stiffening facets disposed in an endwise adjacent array extending transversely about the periphery of said dome between said finish and said sidewall portion, each facet pair having an inwardly-convex chordal stiffening rib forming an inflection between an upright and a transverse facet wall portion of said dome, each facet wall portion having an outwardly convex peripheral rib with an apogee located intermediate opposite ends of said chordal stiffening rib and with portions extending therefrom in opposite directions toward opposite ends of said chordal stiffening rib, said plurality of chordal stiffening ribs defining a regular transverse polygon, said dome including at least a second plurality of pairs of chordal stiffening facets superposed above said first-mentioned plurality of pairs of facets, said second plurality of pairs of facets each having an inwardly-convex chordal stiffening rib forming an inflection between an upright and a transverse facet wall portion of said dome, each facet wall portion having an outwardly convex peripheral rib with an apogee located intermediate opposite ends of said chordal stiffening rib and with portions extending therefrom in opposite directions toward opposite ends of said chordal stiffening rib, said second plurality of pairs of chordal stiffening facets being arranged with endwise adjacent ends of peripherally-adjacent chordal ribs disposed adjacent the apogee of each subjacent upright facet wall portion.

2. An ovalization and crush resistant container according to claim 1, wherein an uneven number of chordal stiffening ribs are utilized.

3. An ovalization and crush resistant container according to claim 2, wherein said uneven number of chordal stiffening ribs is in a range of from about three to about nine.

4. An ovalization and crush resistant container according to claim 1, wherein said outwardly convex peripheral rib of at least said upright facet wall portion is of arcuate shape.

5. An ovalization and crush resistant container according to claim 4, wherein said outwardly convex peripheral rib of at said transverse facet wall portion is of arcuate shape.

6. An ovalization and crush resistant container according to claim 4, wherein said dome slopes upwardly and inwardly above said apogees.

7. An ovalization and crush resistant container according to claim 4, wherein said dome has a narrow annular wall portion connecting said apogees of the upright facet walls to the finish.

8. An ovalization and crush resistant container according to claim 1, wherein said finish is annular and has a diameter of at least 44 mm.

9. An ovalization and crush resistant container according to claim 1, wherein said container is made of polyethylene terephthalate.

10. An ovalization and crush resistant container according to claim 1, wherein each of said chordal stiffening ribs is substantially straight between its opposite ends.

11. An ovalization and crush resistant container according to claim 10, wherein said chordal stiffening ribs are coplanar with one another.

12. An ovalization and crush resistant container according to claim 11, wherein said upright facet wall portion is substantially vertical and said transverse facet wall portion is substantially horizontal.

13. An ovalization and crush resistant container according to claim 1, wherein said superposed second plurality of pairs of facets is inset radially inward of said first plurality of pairs of facets.

14. An ovalization and crush resistant container according to claim 13, wherein said container has a wide mouth finish located inwardly adjacent said superposed second plurality of pairs of facets and is connected thereto by a narrow transitional annular wall portion.

15. An ovalization and crush resistant container having a finish, a base remote from the finish, a sidewall extending from the base, and a dome extending between and connecting the finish to the sidewall, the improvement wherein said dome has an upper tier and a lower tier, said upper tier having a plurality of pairs of chordal stiffening facets disposed in an endwise adjacent array extending transversely about the periphery of said dome between said finish and said lower tier, said lower tier having a plurality of pairs of chordal stiffening facets disposed in an endwise adjacent array extending transversely about the periphery of said dome between said upper tier and said sidewall, each facet pair having an inwardly-convex chordal stiffening rib forming an inflection between an upright and a transverse facet wall portion of said dome, each facet wall portion having an outwardly convex peripheral rib with an apogee located intermediate opposite ends of said chordal stiffening rib and with portions extending therefrom in opposite directions toward opposite ends of said chordal stiffening rib, said plurality of chordal stiffening ribs on each of said upper and lower tiers being of uneven number and defining a regular transverse polygon.

16. An ovalization and crush resistant container according to claim 15, wherein said upper tier is arranged with respect to said lower tier such that said apogees of said upper tier are offset from said apogees of said lower tier.

17. An ovalization and crush resistant container according to claim 15, wherein said regular transverse polygon formed in said lower tier by said inwardly-convex chordal stiffening ribs is a pentagon.

18. An ovalization and crush resistant container according to claim 15, wherein said regular transverse polygon formed in said upper tier by said inwardly-convex chordal stiffening ribs is a pentagon.

19. An ovalization and crush resistant container according to claim 15, wherein each of said chordal stiffening ribs is substantially straight between its opposite ends.

20. An ovalization and crush resistant container according to claim 19, wherein said first plurality of chordal stiffening ribs are coplanar with one another.

21. An ovalization and crush resistant container according to claim 20, wherein said upright facet wall portion is substantially vertical and said transverse facet wall portion is substantially horizontal.

22. An ovalization and crush resistant container according to claim 15, wherein said plurality of pairs of facets of said upper tier is inset radially inward of said plurality of pairs of facets of said lower tier.

23. An ovalization and crush resistant container according to claim 22, wherein said container has a wide mouth finish located inwardly adjacent said plurality of pairs of facets of said upper tier and is connected thereto by a narrow transitional annular wall portion.

24. An ovalization and crush resistant container having a finish, a base remote from the finish, a sidewall extending from the base, and a dome extending between and connecting the finish to the sidewall, the improvement wherein said dome has an upper tier and a lower tier, said upper tier having a plurality of pairs of chordal stiffening facets disposed in an endwise adjacent array extending transversely about the periphery of said dome between said finish and said lower tier, said lower tier having a plurality of pairs of chordal stiffening facets disposed in an endwise adjacent array extending transversely about the periphery of said dome between said upper tier and said sidewall, each facet pair having an inwardly-convex chordal stiffening rib forming an inflection between an upright and a transverse facet wall portion of said dome, each facet wall portion having an outwardly convex peripheral rib with an apogee located intermediate opposite ends of said chordal stiffening rib and with portions extending therefrom in opposite directions toward opposite ends of said chordal stiffening rib, said plurality of chordal stiffening ribs on each of said upper and lower tiers defining a regular transverse pentagon, said upper tier being arranged with respect to said lower tier such that said apogees of said upper tier are offset from said apogees of said lower tier.

25. An ovalization and crush resistant container according to claim 24, wherein said plurality of pairs of facets of said upper tier is inset radially inward of said plurality of pairs of facets of said lower tier.

26. An ovalization and crush resistant container according to claim 25, wherein said container has a wide mouth finish located inwardly adjacent said plurality of pairs of facets of said upper tier and is connected thereto by a narrow transitional annular wall portion.

27. An ovalization and crush resistant container having a wide mouth annular finish, a sidewall, and a dome connecting said finish to said sidewall, said dome having a narrow annular transitional wall portion located immediately below said finish and surrounding said finish, said dome having a plurality of pairs of chordal stiffening facets disposed in an endwise adjacent array extending transversely about the periphery of said dome between said finish and said sidewall, each facet pair having an inwardly-convex chordal stiffening rib forming an inflection between an upright and a transverse facet wall portion of said dome, each facet wall portion having an outwardly convex peripheral rib with an apogee located intermediate opposite ends of said chordal stiffening rib and with portions extending therefrom in opposite directions toward opposite ends of said chordal stiffening rib, said narrow annular transitional wall portion connecting said apogees of said upright facet wall portion to said finish and being radially, outwardly and downwardly inclined between adjacent portions of said outwardly convex ribs defining said upright facet walls.

28. An ovalization and crush resistant container according to claim 22, wherein said upright facet wall rib and said transverse facet wall rib of each facet pair are arcuate with opposite intersecting ends, and wherein said chordal stiffening rib of each facet pair extends between said ends.

29. An ovalization and crush resistant container according to claim 28, wherein said wide mouth finish has a diameter of at least about 45 mm.

* * * * *